US010955108B2

(12) United States Patent
Li et al.

(10) Patent No.: US 10,955,108 B2
(45) Date of Patent: Mar. 23, 2021

(54) CEILING LAMP

(71) Applicant: OPPLE LIGHTING CO., LTD., Shanghai (CN)

(72) Inventors: Guoxiang Li, Shanghai (CN); Shitao Deng, Shanghai (CN); Zhengwang Xu, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 16/234,859

(22) Filed: Dec. 28, 2018

(65) Prior Publication Data

US 2019/0137071 A1 May 9, 2019

Related U.S. Application Data

(63) Continuation of application No. PCT/CN2017/085369, filed on May 22, 2017.

(51) Int. Cl.
*F21V 5/00* (2018.01)
*F21S 8/04* (2006.01)
(Continued)

(52) U.S. Cl.
CPC ..... *F21V 5/005* (2013.01); *F21S 8/04* (2013.01); *F21V 3/10* (2018.02); *F21V 17/06* (2013.01);
(Continued)

(58) Field of Classification Search
CPC .. F21S 8/04; F21S 8/026; F21V 21/03; F21V 21/041; F21V 21/047; F21V 21/048;
(Continued)

(56) References Cited

U.S. PATENT DOCUMENTS 4,611,266 A * 9/1986 Schwartz ..... F21S 8/035 362/311.04
6,561,670 B1 * 5/2003 Jongewaard ..... F21S 8/02 362/147
(Continued)

FOREIGN PATENT DOCUMENTS

CN 101162329 A 4/2008
CN 202469675 U 10/2012
(Continued)

OTHER PUBLICATIONS

International Search Report and Written Opinion (including English translations) issued in PCT/CN2017/085369, dated Aug. 3, 2017, 20 pages.

*Primary Examiner* — Bryon T Gyllstrom
*Assistant Examiner* — James M Endo
(74) *Attorney, Agent, or Firm* — Arch & Lake LLP

(57) ABSTRACT

A ceiling lamp may include: a base plate and a light emitting component arranged on the base plate. The ceiling lamp further includes a diffusing structural member, arranged outside the light emitting component and configured to evenly diffuse light emitted by the light emitting component; and a light transmitting structural member, arranged outside the diffusing structural member. The light transmitting structural member is provided with a microprism structure, and is configured to allow the light evenly diffused by diffusing structural member to form into a pattern corresponding to the microprism structure on the light transmitting structural member.

20 Claims, 12 Drawing Sheets

(51) Int. Cl.

| | |
|---|---|
| ***F21V 17/06*** | (2006.01) |
| ***F21V 3/10*** | (2018.01) |
| ***F21Y 115/10*** | (2016.01) |
| ***F21V 21/04*** | (2006.01) |
| ***F21V 13/12*** | (2006.01) |
| ***F21V 21/03*** | (2006.01) |

(52) U.S. Cl.
CPC ..... *F21V 13/12* (2013.01); *F21V 21/03* (2013.01); *F21V 21/04* (2013.01); *F21Y 2115/10* (2016.08)

(58) Field of Classification Search
CPC ..... F21V 21/049; F21V 13/12; F21V 13/02; F21V 13/04; F21V 5/005; F21V 5/002; F21V 5/02
See application file for complete search history.

(56) References Cited

U.S. PATENT DOCUMENTS 7,828,466 B2 * 11/2010 Daimon ..... C08L 1/18 362/311.02
2002/0048168 A1 * 4/2002 Sejkora ..... F21S 8/04 362/223
2002/0149943 A1 * 10/2002 Obata ..... G09F 13/04 362/339
2008/0088764 A1 4/2008 Son
2010/0053981 A1 * 3/2010 Chuang ..... F21V 5/002 362/336
2012/0236572 A1 * 9/2012 Negley ..... G02B 1/041 362/311.02
2013/0242568 A1 * 9/2013 Asai ..... F21V 5/02 362/311.06
2013/0286646 A1 * 10/2013 Snell ..... F21V 13/04 362/231
2014/0049939 A1 * 2/2014 Kuenzler ..... H04R 1/028 362/84
2014/0176877 A1 6/2014 Son
2014/0376220 A1 * 12/2014 Shen ..... G02B 5/0231 362/235
2016/0053982 A1 2/2016 Kovalchick
2016/0054502 A1 * 2/2016 Sun ..... G08G 1/095 362/235

FOREIGN PATENT DOCUMENTS

CN 203628470 U 6/2014
CN 106090754 A 11/2016
CN 205716784 U 11/2016
CN 205938808 U 2/2017

* cited by examiner

CEILING LAMP

CROSS-REFERENCE TO RELATED APPLICATIONS

This application is based upon and claims the priority of PCT patent application No. PCT/CN2017/085369 filed on May 22, 2017 which claims the priority of Chinese Patent Application No. 201610486124.4 filed on Jun. 28, 2016 and Chinese Patent Application No. 201620655885.3 filed on Jun. 28, 2016, the entire contents of which are hereby incorporated by reference herein.

TECHNICAL FIELD

Examples of the present disclosure relate to a field of lighting, and particularly, to a ceiling lamp.

BACKGROUND

At present, LED lamps are increasingly used in all fields of lighting. As a semiconductor light emitting device, a LED (light emitting diode) has many advantages such as low power consumption, long service life and high reliability as compared with a conventional electric lamp, so it is widely used in the field of lighting, and more and more applied to a field of indoor lighting.

With the improvement of people's quality of life, people pose higher and higher requirements on interior decoration, especially, on lighting fixtures that can best reflect a decoration effect. Therefore, various styles of lighting fixtures enter people's lives, but traditional lamps are mainly used as overhead lighting source for indoor lighting, which is mainly a single-layer lampshade and has a relatively simple shape.

SUMMARY

In order to solve the problems described above, the present disclosure provides a ceiling lamp, including a diffusing structural member and a light transmitting structural member, and the diffusing structural member plays a role of making light even, so that the light passing the diffusing structural member is diffused evenly, thereby avoiding generating effect of uneven brightness in a wide range; and the light transmitting structural member is provided with a microprism structure to change a running direction of the light, so that a pattern corresponding to the microprism structure is formed on the light transmitting structural member after the light passes the light transmitting structural member.

In a first aspect, the present disclosure provides a ceiling lamp, including: a base plate; a light emitting component, including a light emitting unit, the light emitting unit being arranged on the base plate; a diffusing structural member, arranged outside the light emitting unit and configured to evenly diffuse light emitted by the light emitting unit; and a light transmitting structural member, arranged outside the diffusing structural member, the light transmitting structural member being provided with a microprism structure, configured to allow the light evenly diffused by the diffusing structural member to form into a pattern corresponding to the microprism structure on the light transmitting structural member.

The present disclosure further provides a ceiling lamp, including: a base plate; a light emitting component, including a light emitting unit, the light emitting unit being arranged on the base plate; and a light transmitting structural member and a diffusing layer. The light transmitting structural member is arranged outside the light transmitting, and includes a first side facing the light emitting unit. The diffusing layer is arranged on the first side of the light transmitting structural member, and configured to evenly diffuse light emitted by the light emitting component into the light transmitting structural member. The light transmitting structural member is further provided with a microprism structure, and the light transmitting structural member is configured to allow the light evenly diffused by the diffusing structural member to form into a pattern corresponding to the microprism structure.

BRIEF DESCRIPTION OF THE DRAWINGS

Herein, the drawings are intended to provide a further understanding of the present disclosure, and are a part of the present disclosure. Exemplary examples of the present disclosure and descriptions thereof are intended to illustrate the present disclosure, and are not improper limitation to the present disclosure. In the accompanying drawings:

In FIG. 1 to FIG. 3, FIG. 8 to FIG. 10: 100—base plate; 200—lighting emitting component; 210—light emitting unit; 220—driver; 300*a*—diffusing cover; 300*b*—diffusing layer; 310—fixing portion of diffusing cover; 400—light transmitting cover; 410—first side; 420—second side; 430—microprism structure; 431—dot-shaped protrusion; 432—strip-shaped protrusion; 440—bottom portion; 450—side portion; 460—fixing portion of light transmitting cover; 500—transparent cover; 510—fitting portion of transparent cover; 520—fixing portion of transparent cover; 530—pleats; 600—fixing structural member;

In FIG. 4 to FIG. 7, FIG. 11 to FIG. 14: 100'—base plate; 200'—lighting emitting component; 210'—light emitting unit; 220'—driver; 230'—light guiding plate; 240'—reflecting plate; 300*a'*—diffusing plate; 300*b'*—diffusing layer; 400'—light transmitting plate; 410'—first side; 420'—second side; 430'—microprism structure; 431'—dot-shaped protrusion; 500'—transparent cover; 500"—transparent plate; 600'—fixing structural member.

DETAILED DESCRIPTION

Figure 1:
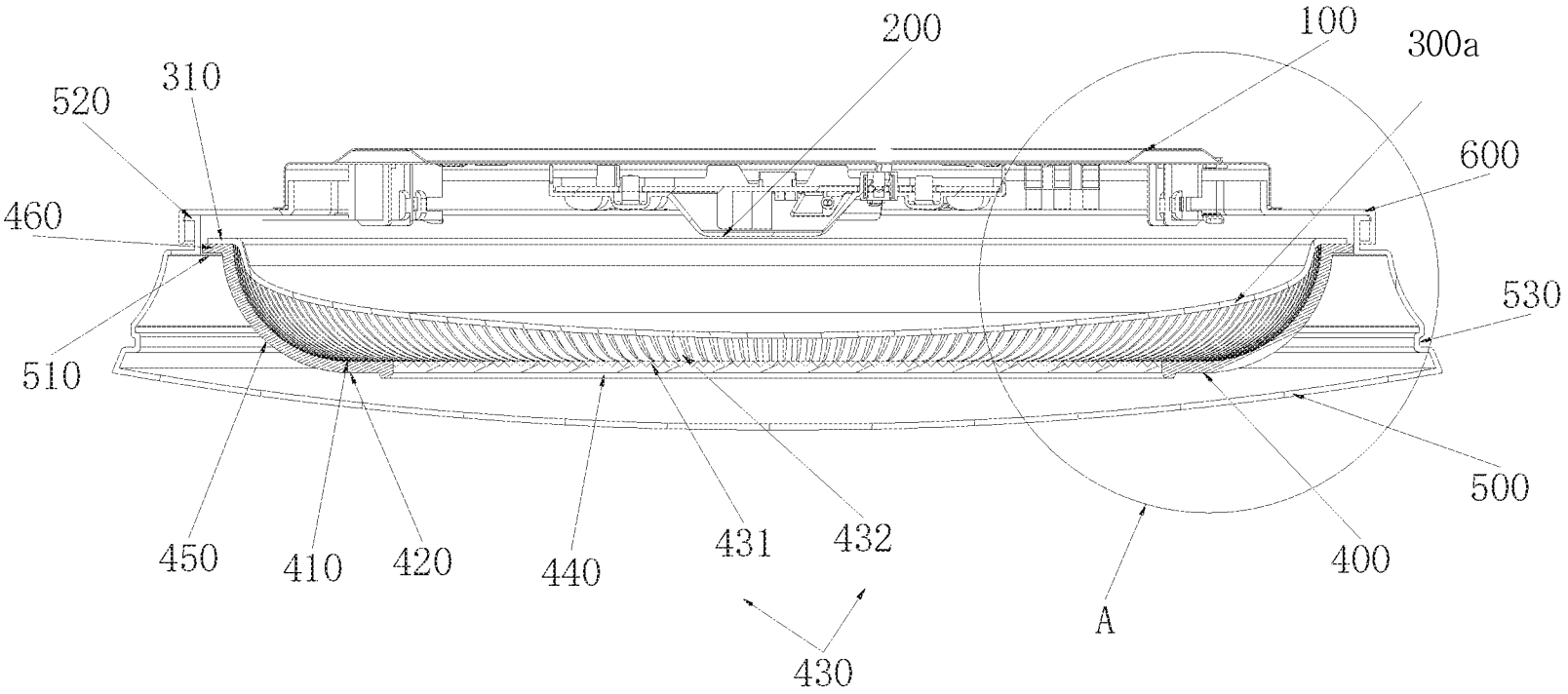
FIG. 1 is a cross-sectional view of a ceiling lamp in one example of the present disclosure.

In order to make objects, technical details and advantages of the embodiments of the present disclosure apparent, the technical solutions of the embodiment will be described in a clearly and fully understandable way in connection with the drawings related to the embodiments of the present disclosure. It is obvious that the described embodiments are just a part but not all of the embodiments of the present disclosure. Based on the described embodiments herein, those ordinarily skilled in the art can obtain other embodiment(s), without any inventive work, which should be within the scope of the present disclosure.

A ceiling lamp according to the present disclosure includes: a base plate 100, 100', a light emitting component 200, 200', a diffusing structural member 300*a*, 300*a*', a light transmitting structural member 400, 400', the light emitting component 200, 200' includes one or a plurality of light emitting units 210, 210' and a driver 220, 220' thereof, the light emitting units 210, 210' are arranged on the base plate 100, 100'; the diffusing structural member 300*a*, 300*a*' is arranged outside the light emitting units 210, 210' and configured to evenly diffuse light emitted by the light emitting components 200, 200'; and the light transmitting structural member 400, 400' is arranged outside the diffusing structural member 300*a*, 300*a*', the light transmitting structural member is provided with a microprism structure 430, 430', configured to allow the light evenly diffused by the diffusing structural member 300*a*, 300*a*' to form into a pattern corresponding to the microprism structure 430, 430' on the light transmitting structural member 400, 400'.

In the present disclosure, the diffusing structural member 300*a*, 300*a*' is formed by adding chemical particles as scattering particles in a substrate material, so that light are continuously refracted, reflected and scattered in two media having different refractive indices upon passing the scattering particles, to generate an effect of optical diffusion. The diffusing structural member 300*a*, 300*a*' is intended to make the light more even and softer, to make one or a plurality of directional light sources evenly distribute light in one plane through conversion of one surface, so that the light passing the diffusing structural member 300*a*, 300*a*' is evenly diffused, thereby avoiding generating effect of uneven brightness in large area.

The light transmitting structural member 400, 400' of the present disclosure includes a first side 410, 410' facing the diffusing structural member 300*a*, 300*a*' and a second side 420, 420' arranged opposite to the first side 410, 410', a part or a whole of surfaces of the first sides 410, 410' and/or the second sides 420, 420' of the light transmitting structural members 400, 400' is provided with the microprism structure 430, 430', so as to change a running route of the light, so as to form into a pattern on the light transmitting structural member 400, 400' after the light passes the light transmitting structural member 400, 400'.

In the present disclosure, the first side 410, 410' is provided with the microprism structure 430, 430', the second side 420, 420' is a smooth structure, and the second side 420, 420' facing outwardly is configured to be a smooth structure, which is not conducive to dust accumulation and is easy to clean.

In the present disclosure, it can further be configured that: the first side 410, 410' can be a smooth structure, the second side 420, 420' is provided with the microprism structure 430, 430', and the second side 420, 420' facing outwardly is provided with the microprism structure 430, 430' to form a concave-convex shape on an outer side of the light transmitting structural member 400, 400', thereby improving visual effect.

In the present disclosure, it can further be configured that: the first side 410, 410' and the second side 420, 420' can be both provided with the microprism structure 430, 430', and the formed pattern is more distinct, and the second side 420, 420' facing outwardly is provided with the microprism structure 430, 430' to form a concave-convex shape on an outer side of the light transmitting structural member 400, 400', thereby improving visual effect.

In the present disclosure, the microprism structure 430, 430' includes concave-convex structures arranged in an array and formed by a part of protrusions and/or a part of concaves on a surface of the light transmitting structural member 430, 430', the light is refracted in different directions upon passing the concave-convex structures arranged in an array of the microprism structure 430, 430', a running route of the light is changed, so as to form into a pattern corresponding to the microprism structure 430, 430' on the light transmitting structural member 400, 400' after passing the light transmitting structural member 400, 400'.

In the present disclosure, the light transmitting structural member 400, 400' is divided into at least two regions in a radial direction or in a circumferential direction, and the microprism structure 430, 430' is arranged in at least one of the at least two regions, and the microprism structure 430, 430 arranged in two adjacent ones of the at least two regions have different shapes. The at least two regions evenly distributed in the radial direction are at least two annular regions distributed radially outward by the center, and the at least two regions distributed in the circumferential direction are two or a plurality of sector regions distributed in the circumferential direction.

The ceiling lamp of the present disclosure further includes: a transparent structural member 500, 500', and the transparent structural member 500, 500' is arranged outside the light transmitting structural member 400, 400', and is of a transparent structure, and configured to transparently diffuse light diffused by the light transmitting structural member 400, 400', and the transparent structural member is of a smooth structure, or concave folds arranged on a transparent cover. The light becomes transparent and bright after passing the transparent structural member 500, 500', thereby improving user experience and visual effect. The transparent structural member 500, 500' is preferably made of a transparent PC material, which has low costs and light weight.

The ceiling lamp of the present disclosure further includes: a fixing structural member 600, 600', and the fixing structural member 600, 600' is configured to fixedly mount the diffusing structural member 300*a*, 300*a*' and/or the light transmitting structural member 400, 400' and/or the transparent structural member 500, 500' on the base plate 100, 100', one end of the fixing structural member 600, 600' is fixedly connected with the diffusing structural member 300*a*, 300*a*' and/or the light transmitting structural member 400, 400' and/or the transparent structural member 500, 500', and another end of the fixing structural member is fixedly connected with the base plate 100, 100'; and the fixing structural member 600, 600' are of a frame-shaped member.

The light emitting component 200, 200' in the present disclosure are a side-in type light emitting component or a direct-in type light emitting component.

An example of the disclosure is an LED ceiling lamp, and the light emitting component 200, 200' is a LED light emitting component.

In an example of the present disclosure, the light transmitting structural member 400, 400' is a light transmitting cover 400 of a cover-shell structure having a containing cavity, and the diffusing structural member 300*a*, 300*a*' is a diffusing cover 300*a* of a cover-shell structure having a cavity, and thus the light transmitting cover 400 and the diffusing cover 300*a* having a cover-shell structure make the ceiling lamp more stereoscopic.

Figure 2:
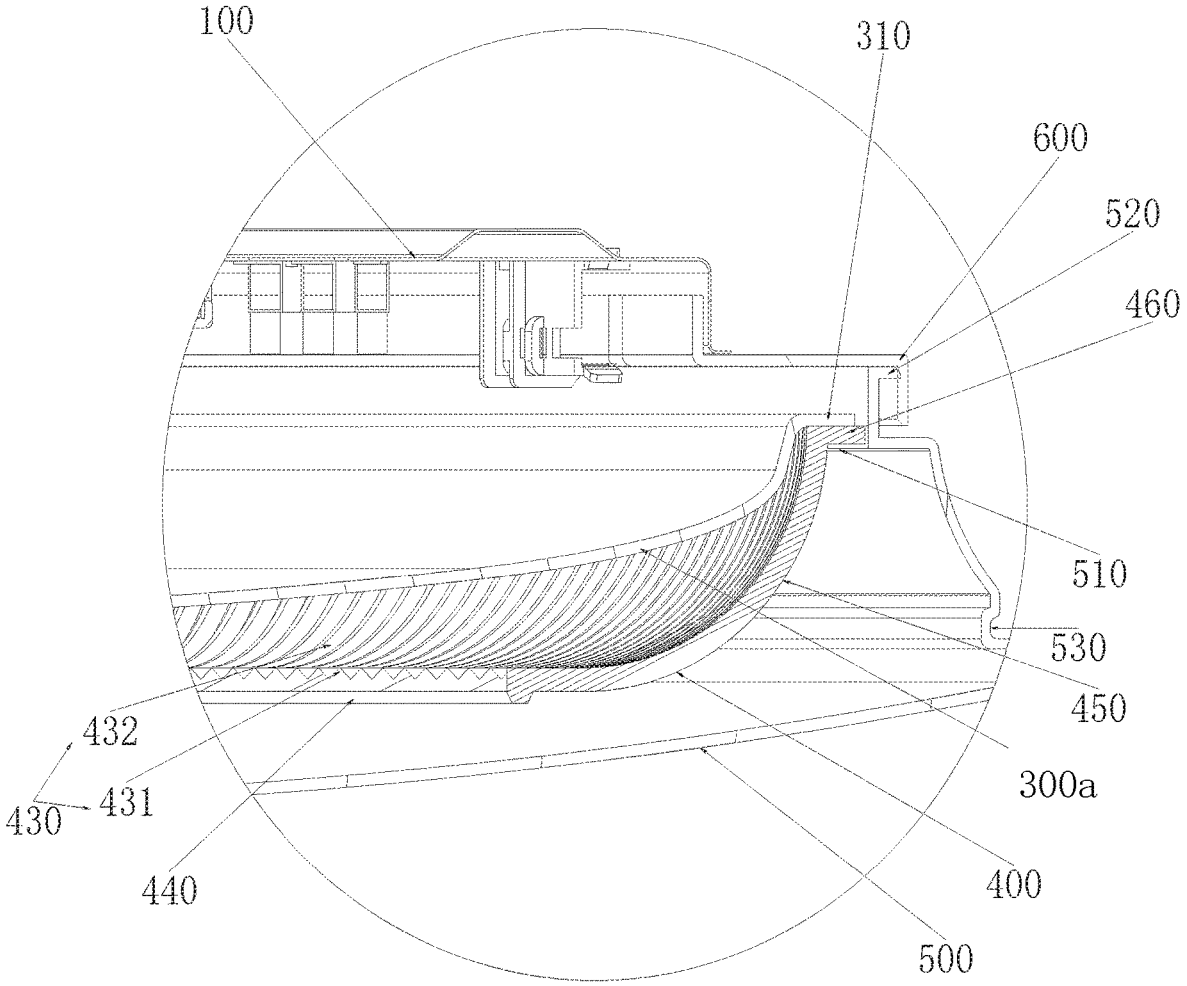
FIG. 2 is an enlarged view of a position A of FIG. 1.
Figure 3:
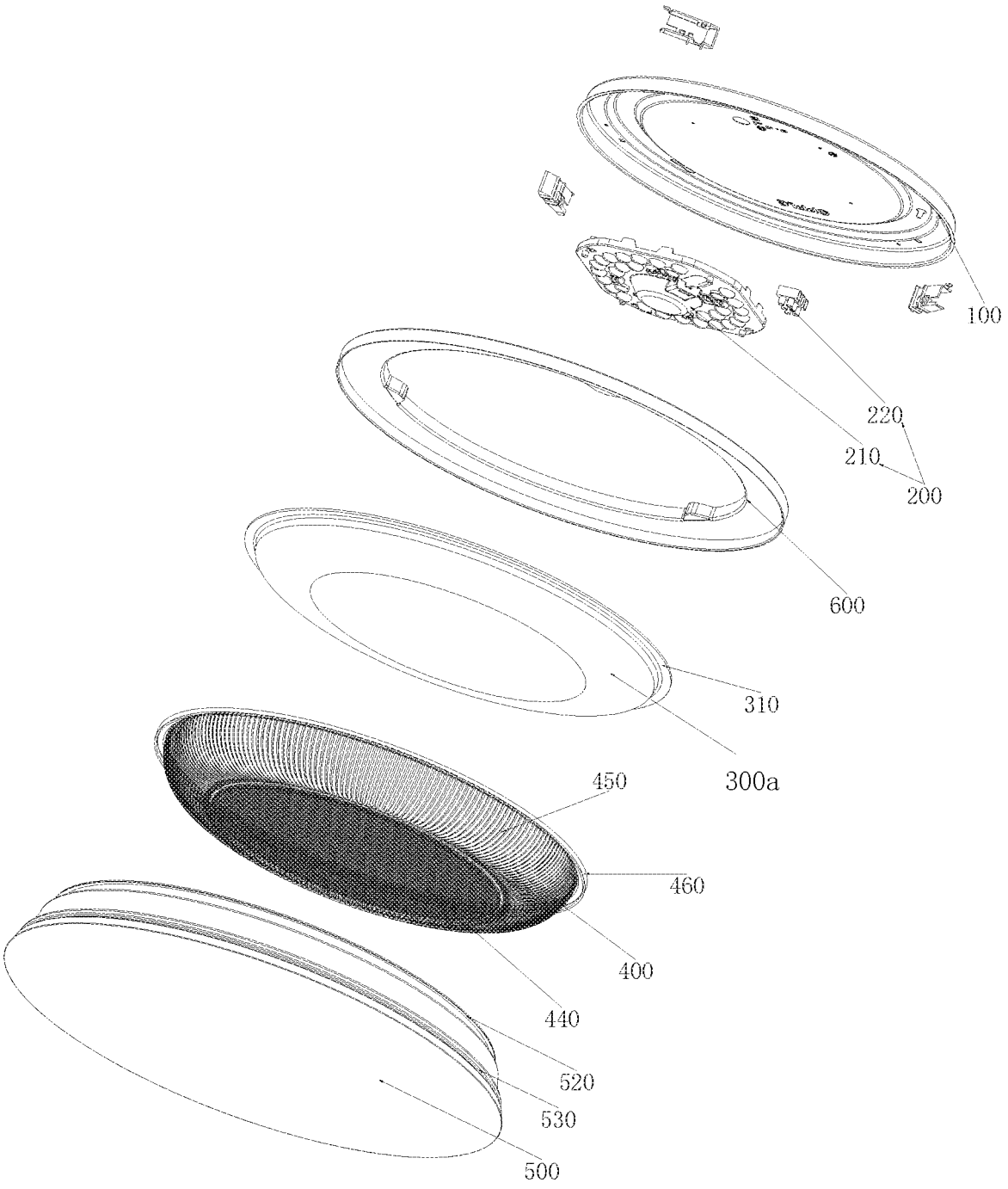
FIG. 3 is an exploded structural diagram of a ceiling lamp in one example of the present disclosure.
Figure 4:
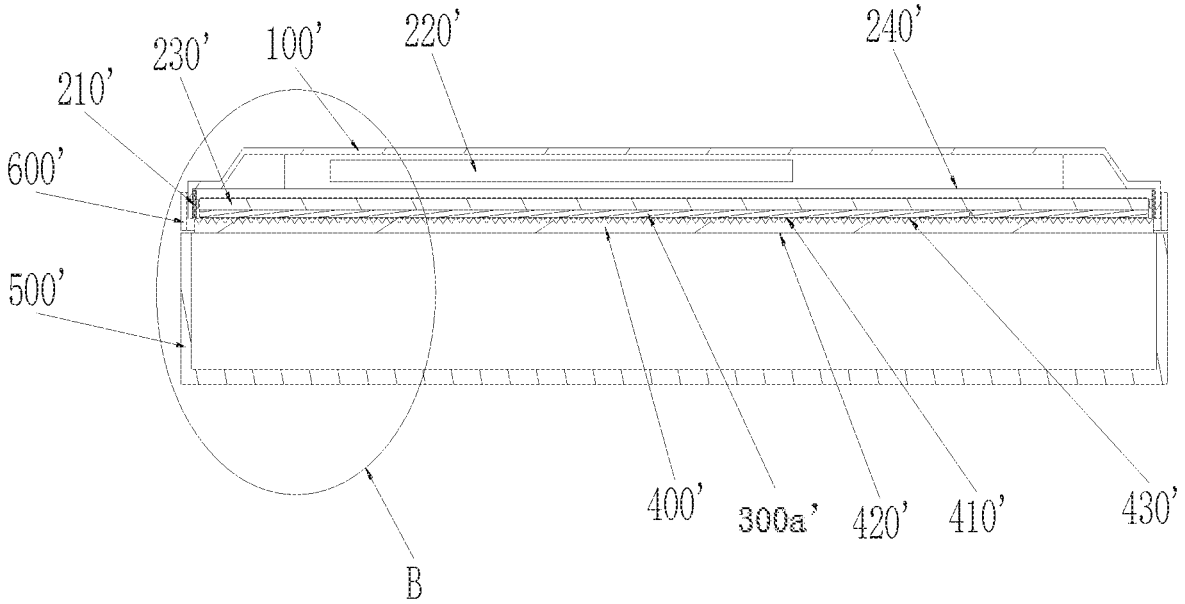
FIG. 4 is a cross-sectional view of a ceiling lamp in another example of the present disclosure.
Figure 5:
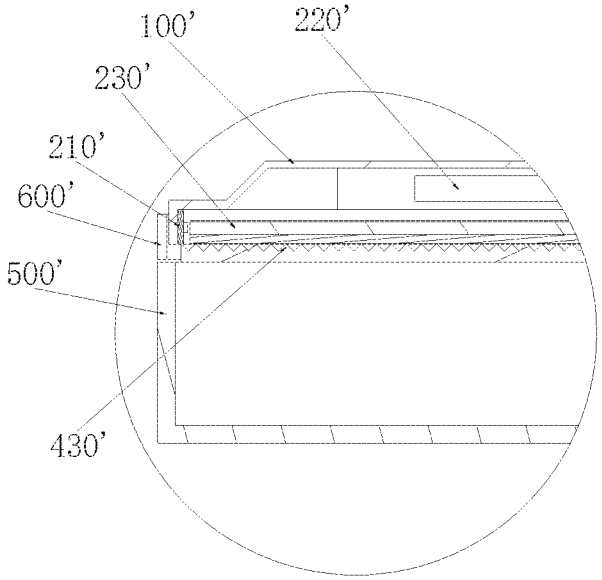
FIG. 5 is an enlarged view of a position B of FIG. 4.
Figure 6:
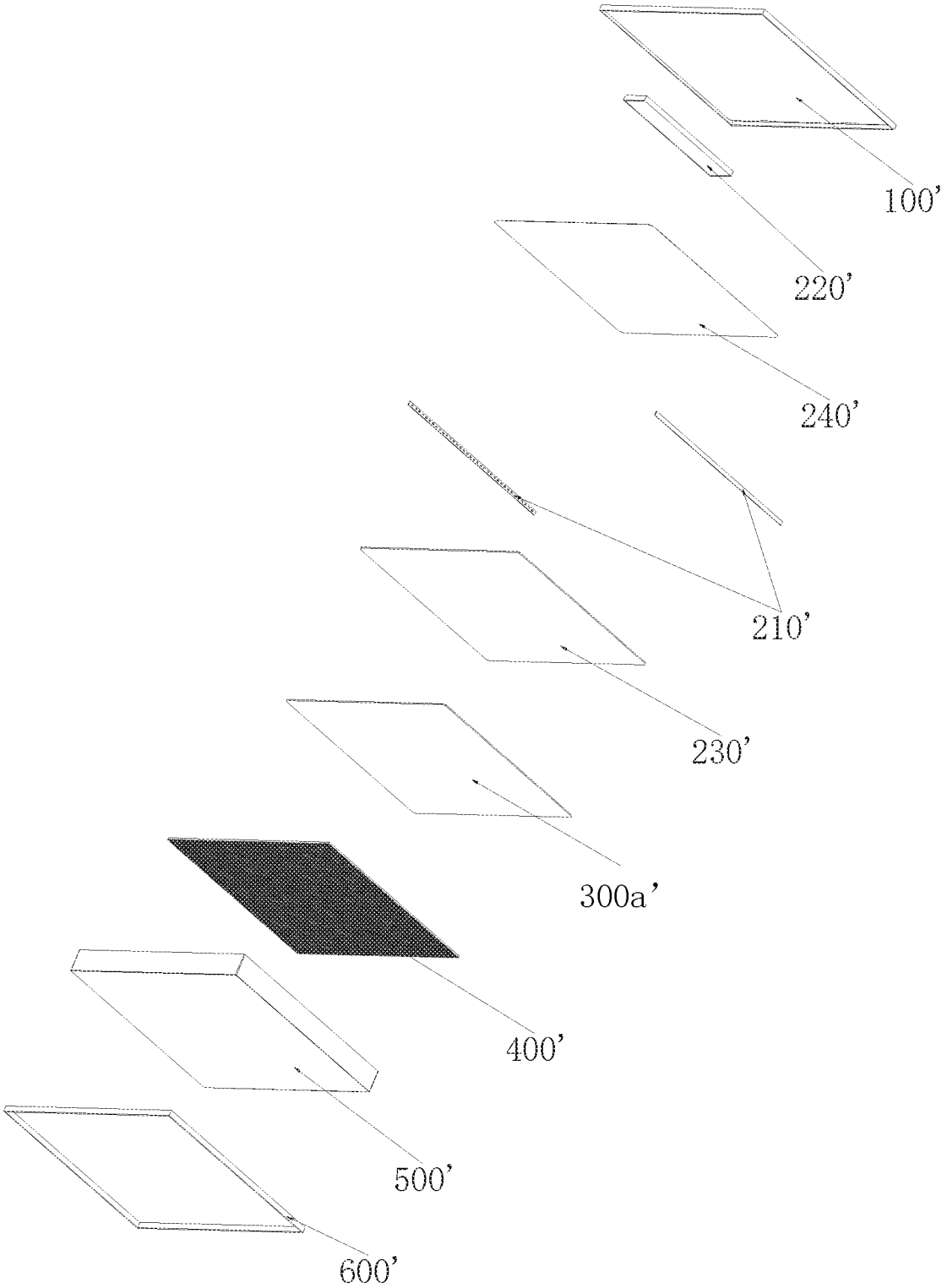
FIG. 6 is an exploded structural diagram of a ceiling lamp in another example of the present disclosure.
Figure 7:
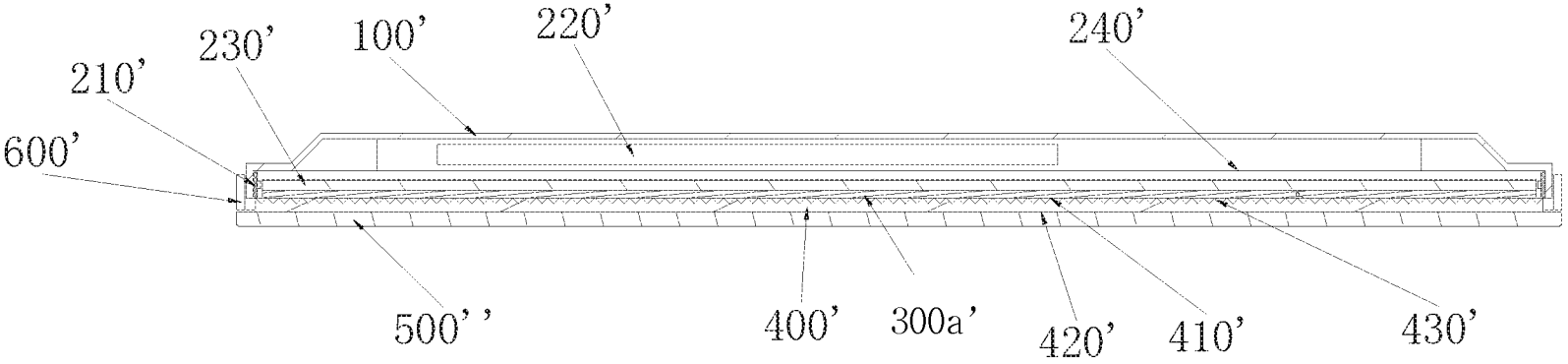
FIG. 7 is a cross-sectional view of a ceiling lamp in another example of the present disclosure.
Figure 8:
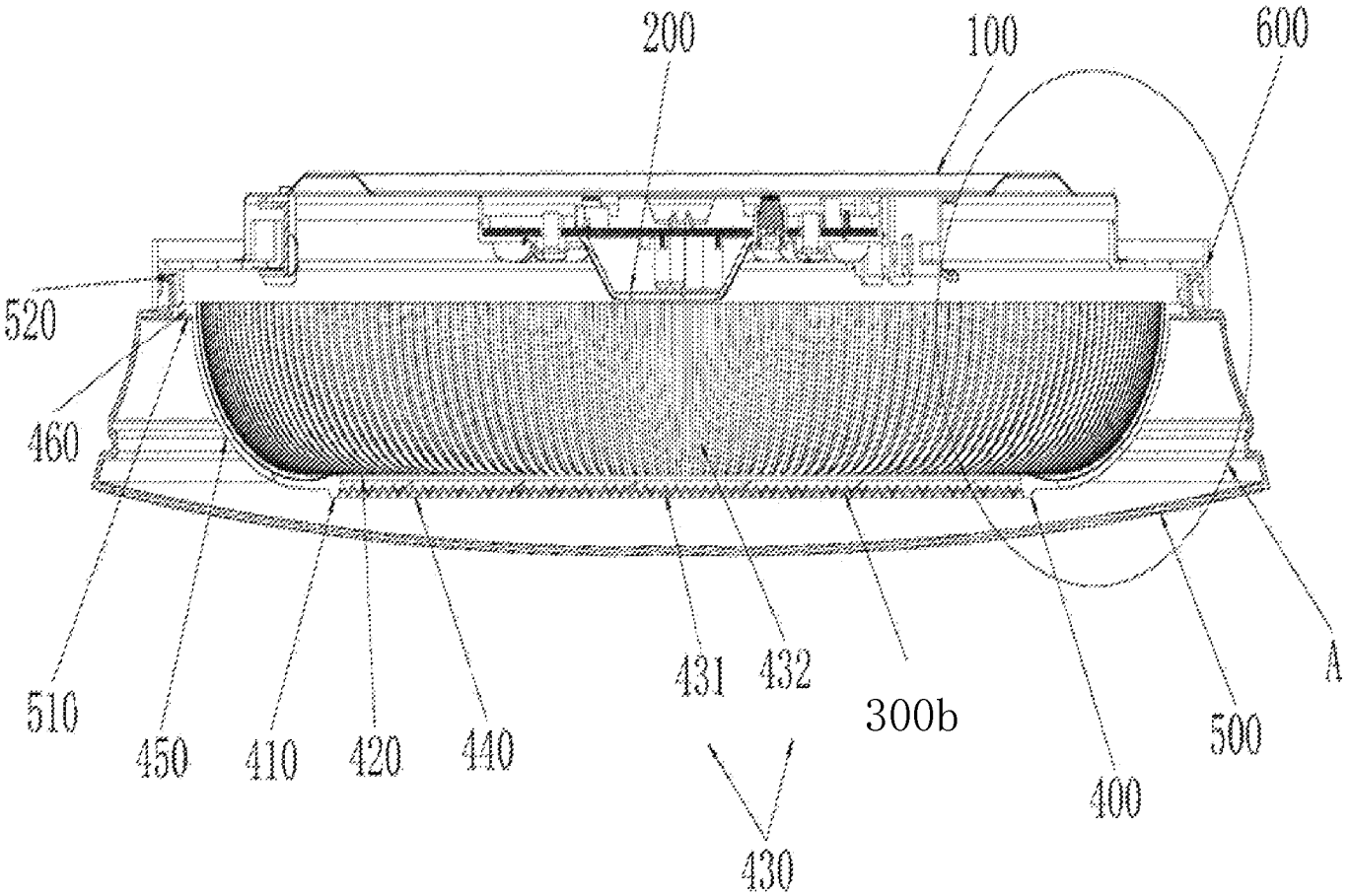
FIG. 8 is a cross-sectional view of a ceiling lamp in another example of the present disclosure.

As shown in FIG. 1 to FIG. 3, a ceiling lamp according to the present example includes: a base plate 100, a light emitting component 200, a diffusing cover 300*a*, a light transmitting cover 400, the light emitting component 200 includes one or a plurality of light emitting units and a driver thereof, and is arranged on the base plate 100; the diffusing cover 300*a* is arranged outside the light emitting unit 210 and configured to evenly diffuse light emitted by the light emitting component 200; and the light transmitting cover 400 is arranged outside the diffusing cover 300*a*, the light transmitting cover 400 is provided with a microprism structure 430, configured to allow the light evenly diffused by the diffusing cover 300 to form into a pattern corresponding to the microprism structure 430 on the light transmitting cover 400.

In the example, optionally, the diffusing cover 300*a* is an arc-shaped cover, in which an edge is mounted with the base plate 100, and a containing cavity is formed in a central position after being mounted, and the light emitting component 200 can be arranged in the central position of the containing cavity and fixed with the base plate 100.

In the example, optionally, the light transmitting cover 400 includes a bottom portion 440 and a side portion 450, the side portion 450 is arranged in a peripheral region of the bottom portion 440 and forming a predetermined angle with the bottom portion 440, the side portion 450 and the bottom portion 440 form a containing cavity of a lighting emitting component 200, that is, the light transmitting cover 400 includes a bottom portion 440 and a side portion 450 turning over and extending from an edge of the bottom portion 440 in an direction having an angle with respect to the bottom portion 440, and the microprism structure 430 is arranged on the bottom portion 440 and/or the side portion 450. Preferably, the microprism structures 430 respectively arranged in the bottom portion 440 and the side portion 450 have different shapes. On one aspect, the bottom portion 440 and the side portion 450 are respectively provided with the microprism structures having different shapes, so as to improve diversity of a ceiling lamp pattern, thereby avoiding single structure, and making different regions of the ceiling lamp generate different lighting effects.

In the present example, optionally, a convex structure of the microprism structure on the bottom portion of the light transmitting cover 400 is a dot-shaped protrusion 431, and preferably, the dot-shaped protrusion 431 has a polygonal pyramid structure. The microprism structure 430 can be not arranged on the side portion 450 of the light transmitting cover 400, or other forms of the microprism structure 430 is arranged in the side portion 450 of the light transmitting cover 400.

In the present example, optionally, the convex structure of the microprism structure on the side portion of the light transmitting cover 400 is a strip-shaped protrusion 432, and the strip-shaped protrusion 432 is extended from an edge of the bottom portion 440 to an edge of the side portion 450, and moreover, the strip-shaped protrusion 432 has a structure having a polygonal cross section. The plurality of strip-shaped protrusions 432 arranged in an array can be further extended from an edge of the bottom portion 440 to an edge of the side portion 450 to form a spiral structure. The microprism structure 430 can be not arranged on the bottom portion 440 of the light transmitting cover 400, or other forms of the microprism structure 430 can be arranged on the bottom portion 440 of the light transmitting cover 400.

In the present example, optionally, the microprism structure 430 on the bottom portion 440 of the light transmitting cover 400 includes a plurality of dot-shaped protrusions 431 arranged in an array on a surface of the bottom portion 440 of the light transmitting cover 400, and preferably the dot-shaped protrusion 431 has a polygonal pyramid structure; the microprism structure 430 on the side portion 450 of the light transmitting cover 400 includes a plurality of strip-shaped protrusions 432 arranged in an array on the side portion 450 of the light transmitting cover 400, and the strip-shaped protrusion 432 is extended from an edge of the bottom portion 440 to an edge of the side portion 450, and moreover, the strip-shaped protrusion 432 has a structure having a polygonal cross section. The plurality of strip-shaped protrusions 432 arranged in an array can be further extended from an edge of the bottom portion 440 to an edge of the side portion 450 to form a spiral structure.

The polygon may include a triangle, a quadrangle, a trapezoid or other polygons, and the polygonal pyramid can be a triangular pyramid, a quadrangular pyramid, a hexagonal pyramid or other polygonal pyramids.

In the present example, a gap is provided between the diffusing cover 300*a* and the light transmitting cover 400 to form a cavity, and even light passing the diffusing cover 300*a* is refracted, scattered by air in the cavity before entering the light transmitting cover 400, so as to improve stereoscopic effect of the ceiling lamp.

In the present example, the transparent structural member 500, 500', 500" is a transparent cover 500 of a cover-shell structure having a cavity, that is, the ceiling lamp further includes: a transparent cover 500, and the transparent cover 500 is a cover-shell structure made of a transparent material, arranged outside the light transmitting cover 400, has a smooth structure and is configured to be transparently emit the light passing the transparent cover 500. The light becomes transparent and bright after passing the transparent cover 500, improving user experience and visual effects.

In the example, a gap is provided between the light transmitting cover 400 and the transparent cover 500 to form a cavity, and light passing the light transmitting cover 400 is refracted, scattered by air in the cavity before entering the transparent cover 500, so as to improve stereoscopic effect of the ceiling lamp.

In the example, a fixing portion 310 of a diffusing cover is formed by a revers extended by an edge of the diffusing cover 300*a* away from a center, a fixing portion 460 of a light transmitting cover is formed by a revers extended by an edge of the light transmitting cover 400 away from a center, a fitting portion 510 of a transparent cover is formed by a revers extended by an edge of the transparent cover 500 close to a center, and a fixing portion 520 of the transparent cover is formed by a revers extended by an edge of the transparent cover 500 away from a center, and the fixing portion 520 of the transparent cover is mounted on the base plate 100 through a fixing structural member 600, and the fitting portion 510 of the transparent cover fixes the fixing portion 310 of the diffusing cover 300*a* and the fixing portion 460 of the light transmitting cover, referring to FIG. 2.

In the example, the light emitting component 200 is a direct-in type light emitting component, and the light emitting component 200 includes: a substrate, a light emitting unit 210 and a driver 220 arranged on the substrate (the light emitting unit 210 and the driver 220 can have a substrate respectively, and then be assembled together), and an integrated optical component is further included, and provided with an annular lens cover, provided with an annular lens cover, or provided with a plurality of lens units in one-to-one correspondence with the light emitting units 210. A wire hole is further opened in the substrate, adjacent to the driver 220. And a magnetic mounting component is further included, and arranged on the substrate and/or an optical component, and attached to the base plate 100.

In another example of the present disclosure, the light transmitting structural member 400, 400' is a light transmitting plate 400' of a flat plate structure, and the diffusing structural member 300*a*, 300*a'* is a diffusing plate 300*a'* of a flat plate structure, and the light transmitting plate 400' and the diffusing plate 300*a'* of the flat plate structure make overall style of the ceiling lamp simple and delicate.

As shown in FIG. 4 to FIG. 7, a ceiling lamp according to the example includes: a base plate 100', a light emitting component 200', a diffusing plate 300*a'*, and a light transmitting plate 400', the light emitting component 200' is a side-in type light emitting component and arranged on the base plate 100', the light emitting component 200' includes a light guiding plate 230', a light emitting unit 210' and a driver 220', and further includes a reflecting plate 240', the light guiding plate 230' is arranged parallel to the diffusing plate 300*a'*; the light emitting unit 210' is arranged in a same plane as the light guiding plate 230' and located at an end portion of the light guiding plate 230'. The diffusing plate 300*a'* is arranged outside the light emitting source 210', and configured to evenly diffuse light emitted by the light emitting source 210'; the light transmitting plate 400' is arranged outside the diffusing plate 300*a'*, the light transmitting plate 400' is provided with a microprism structure 430', configured to allow the light evenly diffused by diffusing plate 300*a'* to form into a pattern corresponding to the microprism structure 430' on the light transmitting plate 400'.

The diffusing plate 300*a'* is arranged parallel to the light guiding plate 230', the diffusing plate 300*a'* is arranged below the light guiding plate 230', the light transmitting plate 400' is arranged parallel to the diffusing plate 300*a'*, and the light transmitting plate 400' is arranged below the diffusing plate 300*a'*, so as to flatten the entire ceiling lamp, occupying small space.

The microprism structure 430' is a concave-convex structure arranged in an array and formed by a part of protrusions and/or a part of concaves on a surface of the light transmitting plate 400', and the convex structure of the microprism structure of the light transmitting plate 400' is a dot-shaped protrusion 431' and/or a strip-shaped protrusion.

The structure of the dot-shaped protrusion 431' is a polygonal pyramid structure, and the strip-shaped protrusion has a structure having a polygonal cross section.

In the example, optionally, the microprism structures 430 arranged on the entire surface of the light transmitting plate 400' have a same shape, or the light transmitting plate 400' is divided into at least two regions, the microprism structure 430' is arranged in surfaces of the at least two regions, and the microprism structures 430' arranged in two adjacent regions have different shapes.

The light emitting component in the example is a side-in type light emitting component, including: a light guiding plate 230', a light emitting unit 210' and a driver 220' of the light emitting unit 210', the light guiding plate 230' is arranged parallel to the diffusing plate 300*a*; the light emitting unit 210' is in a same plane as the light guiding plate 230', and located at an end portion of the light guiding plate 230'. The light emitting component occupies small space, and further includes a reflecting plate 240' to reflect light scattered upwardly to a lower part.

Further, in the example, a transparent structural member 500, 500', 500" is further included, and the transparent structural member 500, 500', 500" is a transparent cover 500' of a cover-shell structure having a cavity (referring to FIG. 4), a cavity is provided between the transparent cover 500 and the light transmitting plate 400', so that the ceiling lamp has strong stereoscopic effect; or the transparent structural member 500, 500' is a transparent plate 500" of a flat plate structure (referring to FIG. 7), the transparent plate 500' is arranged parallel and close to the light transmitting plate 400', so that the ceiling lamp is flat and occupied smaller space.

The example of the present disclosure further provides a ceiling lamp, including: a base plate 100, 100', a light emitting component 200, 200', a diffusing layer 300, 300*b*, and a light transmitting structural member 400, 400'. The light emitting component 200, 200' includes one or a plurality of light emitting units 210, 210' and a driver 220, 220' thereof. The light emitting units 210, 210' are arranged in the base plate 100, 100'; the light transmitting structural member 400 is arranged outside the light emitting units 210, 210', and have a first side 410, 410' facing the light emitting unit 210, 210'; the diffusing layer 300*b* is arranged on the first side 410, 410' of the light transmitting structural member, and the diffusing layer 300*b*, 300*b'* is configured to evenly diffuse light emitted by the light emitting unit 210, 210' into the light transmitting structural member 400, 400'; and the light transmitting structural member 400, 400' is provided with the microprism structure 430, 430', the light transmitting structural member 400, 400' is configured to form patterns corresponding to the microprism structures 430, 430' with the light evenly diffused by diffusing layer 430, 430'.

In the present disclosure, the diffusing layer 300*b*, 300*b'* is configured to make light be continuously refracted, reflected and scattered in two media having different refractive indices upon passing the diffusing layer, so as to generate effect of optical diffusion. The diffusing layer 300*b* is intended to make the light more even and softer, to make one or a plurality of directional light sources evenly distribute light in one plane through conversion of one surface, so that the light passing the diffusing layer 300*b*, 300*b'* is evenly diffused, thereby avoiding generating effect of uneven brightness in large area.

The light transmitting structural member 400, 400' of the present disclosure have a first side 410, 410' facing the light emitting unit 210, 210' and a second side 420, 420' arranged opposite to the first side 410, 410', a part or a whole of the surface of the first side 410, 410' and/or the second side 420, 420' of the light transmitting structural member 400, 400' is provided with the microprism structure 430, 430', so as to change a running route of light, thereby forming a pattern on the light transmitting structural members 400, 400' after passing the light transmitting structural member 400, 400'.

In the present disclosure, it can be configured that, the first side 410, 410' is provided with the microprism structure 430, 430', the second side 420, 420' is of a smooth structure, the diffusing layer 300*b*, 300*b'* is arranged on the microprism structure 430, 430' of the first side 410, 410', and the second side 420, 420' facing outwardly is configured to be of a smooth structure, which is not conducive to dust accumulation and easy to clean.

In the present disclosure, it can be configured that: the first side 410, 410' can be a smooth plane, the second side 420, 420' is provided with the microprism structure 430, 430', the diffusing layer 300*b*, 300*b'* is arranged on the smooth structure of the first side 410, 410', and the second side 420, 420' facing outwardly is provided with the microprism structure 430, 430' to form a concave-convex shape on a outer side of the light transmitting structural member 400, 400', thereby improving visual effect, and moreover, the smooth structure of the first side facilitate placing the diffusing layer 300*b*, 300*b'*.

In the present disclosure, it can be further configured that: the first side 410, 410' and the second side 420, 420' are both provided with the microprism structure 430, 430', the diffusing layer 300*b*, 300*b*' is arranged on the microprism structure of the first side 410, 410', to form more bright pattern, and meanwhile, the second side 420, 420' facing outwardly is provided with the microprism structure 430, 430' to form a concave-convex shape on an outer side of the light transmitting structural member 400, 400', thereby improving visual effect.

In the present disclosure, the microprism structure 430, 430' includes concave-convex structures arranged in an array and formed by a part of protrusions and/or a part of concaves on a surface of the light transmitting structural member 430, 430', the light is refracted in different directions upon passing the concave-convex structures arranged in an array of the microprism structure 430, 430', a running route of the light is changed, so as to form into a pattern corresponding to the microprism structure 430, 430' on the light transmitting structural member 400, 400' after passing the light transmitting structural member 400, 400'. A convex structure of the concave-convex structure is a dot-shaped protrusion 431, 431' and/or a strip-shaped protrusion 432.

In the present disclosure, the diffusing layer 300*b*, 300*b*' is a diffusing material coating layer coated on the first side of the light transmitting structural member 400, 400', and the diffusing material coating layer has uniform thickness. The diffusing material layer can be a diffusing material layer formed by coating any diffusing material on the light transmitting structural member 400, 400', and preferably, the diffusing material coating layer is a PMMA coating layer.

In the present disclosure, the light transmitting structural member 400, 400' is divided into at least two regions in a radial direction or in a circumferential direction, and microprism structure 430, 430' is arranged in at least one of the at least two regions, and the microprism structures 430, 430 arranged in adjacent ones of the at least two regions have different shapes. The at least two regions evenly distributed in the radial direction are at least two annular regions distributed radially outward by the center, and the at least two regions distributed in the circumferential direction are two or a plurality of sector regions distributed in the circumferential direction.

The ceiling lamp of the present disclosure further includes: a transparent structural member 500, 500', 500" and the transparent structural member 500, 500', 500" is arranged outside the light transmitting structural member 400, 400', and is of a transparent structure, and configured to transparently diffuse light diffused by the light transmitting structural member 400, 400', and the transparent structural member is of a smooth structure, or concave folds arranged on a transparent cover. The light becomes transparent and bright after passing the transparent structural member 500, 500', 500", thereby improving user experience and visual effects. The transparent structural member 500, 500', 500" is preferably made of a transparent PC material, which has low costs and light weight.

The ceiling lamp of the present disclosure further includes: a fixing structural member, and the fixing structural member is configured to fixedly mount the light transmitting structural member 400, 400' and/or the transparent structural member on the base plate, one end of the fixing structural member is fixedly connected with the light transmitting structural member 400 and/or the transparent structural member, and another end of the fixing structural member is fixedly connected with the base plate; and the fixing structural member is a frame-shaped member.

The light emitting components in the present disclosure are a side-in type light emitting component or a direct-in type light emitting component.

An example of the disclosure is an LED ceiling lamp, wherein the light emitting component 200 is a LED light emitting component.

In an example of the present disclosure, the light transmitting structural member 400, 400' is a light transmitting cover 400 of a cover-shell structure having a containing cavity, and the diffusing layer 300*b* is arranged on a first side 410 of the light transmitting cover, and thus the light transmitting cover 400 having a cover-shell structure makes the ceiling lamp more stereoscopic.

As shown in FIG. 8 to FIG. 14, a ceiling lamp according to the example includes: a base plate 100, a light emitting component 200, a light transmitting cover 400, the light emitting component 200 is preferably a direct-in type light emitting component, and includes one or a plurality of light emitting units 210 and a driver 220 thereof, and the light emitting unit is arranged on the base plate 100; the light transmitting cover 400 is arranged outside the light emitting unit 210, has a first side 410 facing the light emitting unit, and a diffusing layer 300*b* is arranged on the first side 410 of the light transmitting cover 400, and the diffusing layer 300*b* is configured to evenly diffuse light emitted by the light emitting component 200 into the light transmitting cover 400, and the light transmitting cover 400 is provided with a microprism structure 430, and the light transmitting cover 400 is configured to allow the light evenly diffused by diffusing layer 300*b* to form into a pattern corresponding to the microprism structure.

In the present disclosure, the diffusing layer 300*b* is a diffusing material coating layer coated on the first side of the light transmitting cover 400, and the diffusing material coating layer has uniform thickness. The diffusing material layer can be a diffusing material layer formed by coating any diffusing material on the light transmitting cover, and preferably, the diffusing material coating layer is a polymethyl methacrylate (PMMA) coating layer.

In the example, optionally, the light transmitting cover 400 is an arc-shaped cover, in which an edge is mounted with the base plate 100, and a containing cavity is formed in a central position after being mounted, and the light emitting unit 210 can be arranged in the central position of the containing cavity to be fixed with the base plate 100.

In the example, optionally, the light transmitting cover 400 includes a bottom portion 440 and a side portion 450, the side portion 450 is arranged in a peripheral region of the bottom portion 440 and forming a predetermined angle with the bottom portion 440, the side portion 450 and the bottom portion 440 form a containing cavity of the lighting emitting unit 210, that is, the light transmitting cover has a bottom portion 440 and a side portion 450 turning over and extending from an edge of the bottom portion 440 in an direction having an angle with respect to the bottom portion 440, and the microprism structure 430 is arranged on the bottom portion 440 and/or the side portion 450. Preferably, the microprism structures 430 arranged on the bottom portion 440 and the side portion 450 have different shapes. On one aspect, the bottom portion 440 and the side portion 450 are respectively provided with the microprism structures having different shapes, so as to improve diversity of a ceiling lamp pattern, avoiding single structure, and making different regions of the ceiling lamp generate different lighting effects.

In the example, optionally, a convex structure of the microprism structure 430 on the bottom portion 440 of the light transmitting cover 400 is a dot-shaped protrusion 431, and preferably, the dot-shaped protrusion 431 has a polygonal pyramid structure. The microprism structure 430 can be not arranged in the side portion 450 of the light transmitting cover 400, or other forms of the microprism structure 430 is arranged in the side portion 450 of the light transmitting cover 400.

In the example, optionally, a convex structure of the microprism structure 430 on the side portion 450 of the light transmitting cover 400 is a strip-shaped protrusion 432, and the strip-shaped protrusion 432 is extended from an edge of the bottom portion 440 to an edge of the side portion 450, and moreover, the strip-shaped protrusion 432 includes a structure having a polygonal cross section. The plurality of strip-shaped protrusions 432 arranged in an array can be further extended from an edge of the bottom portion 440 to an edge of the side portion 450 to form a spiral structure. The microprism structure 430 can be not arranged in the bottom portion 440 of the light transmitting cover 400, or other forms of the microprism structure 430 can be arranged on the bottom portion 440 of the light transmitting cover 400.

In the example, optionally, the microprism structure 430 on the bottom portion 440 of the light transmitting cover 400 includes a plurality of dot-shaped protrusions 431 arranged in an array on a surface of the bottom portion 440 of the light transmitting cover 400, and preferably the dot-shaped protrusion 431 has a polygonal pyramid structure; the microprism structure 430 on the side portion 450 of the light transmitting cover 400 includes a plurality of strip-shaped protrusions 432 arranged in an array on the side portion 450 of the light transmitting cover 400, and the strip-shaped protrusion 432 is extended from an edge of the bottom portion 440 to an edge of the side portion 450, and moreover, the strip-shaped protrusion 432 has a structure having a polygonal cross section. The plurality of strip-shaped protrusions 432 arranged in an array can be further extended from an edge of the bottom portion 440 to an edge of the side portion 450 to form a spiral structure.

The polygon is a triangle, a quadrangle, a trapezoid or other polygons, and the polygonal pyramid can be a triangular pyramid, a quadrangular pyramid, a hexagonal pyramid or other polygonal pyramids.

In the present example, the transparent structural member 500, 500', 500" is a transparent cover 500 of a cover-shell structure having a cavity, that is, the ceiling lamp further includes: a transparent cover 500, and the transparent cover 500 is a cover-shell structure made of a transparent material, arranged outside the light transmitting cover 400, has a smooth structure and is configured to be transparently diffuse the light passing the transparent cover 500. The light becomes transparent and bright after passing the transparent cover 500, improving user experience and visual effects.

In the example, a gap is provided between the light transmitting cover 400 and the transparent cover 500 to form a cavity, and light passing the light transmitting cover 400 is refracted, scattered by air in the cavity before entering the transparent cover 500, so as to improve stereoscopic effect of the ceiling lamp.

Figure 9:
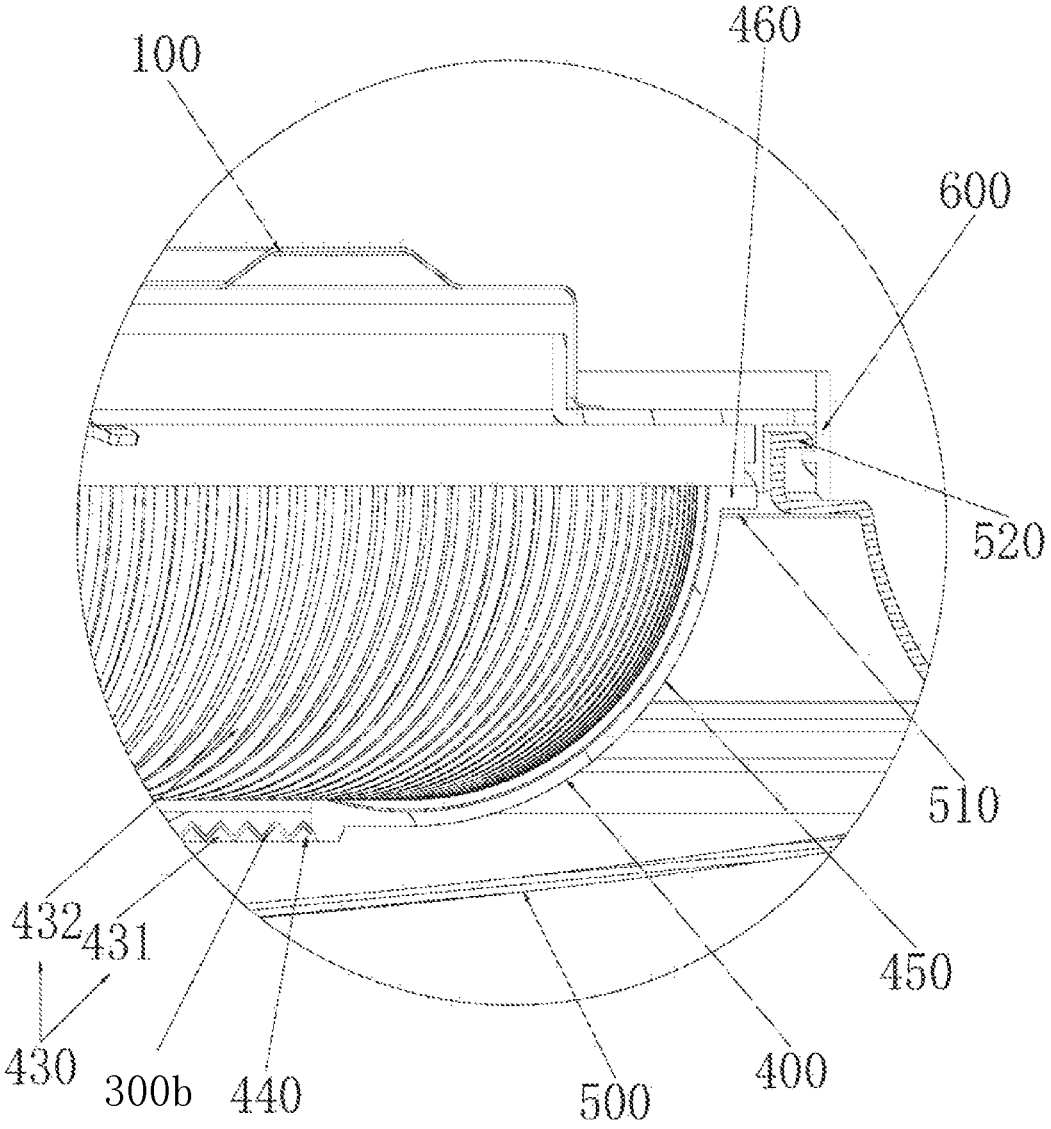
FIG. 9 is an enlarged view of a position A of FIG. 8.
Figure 10:
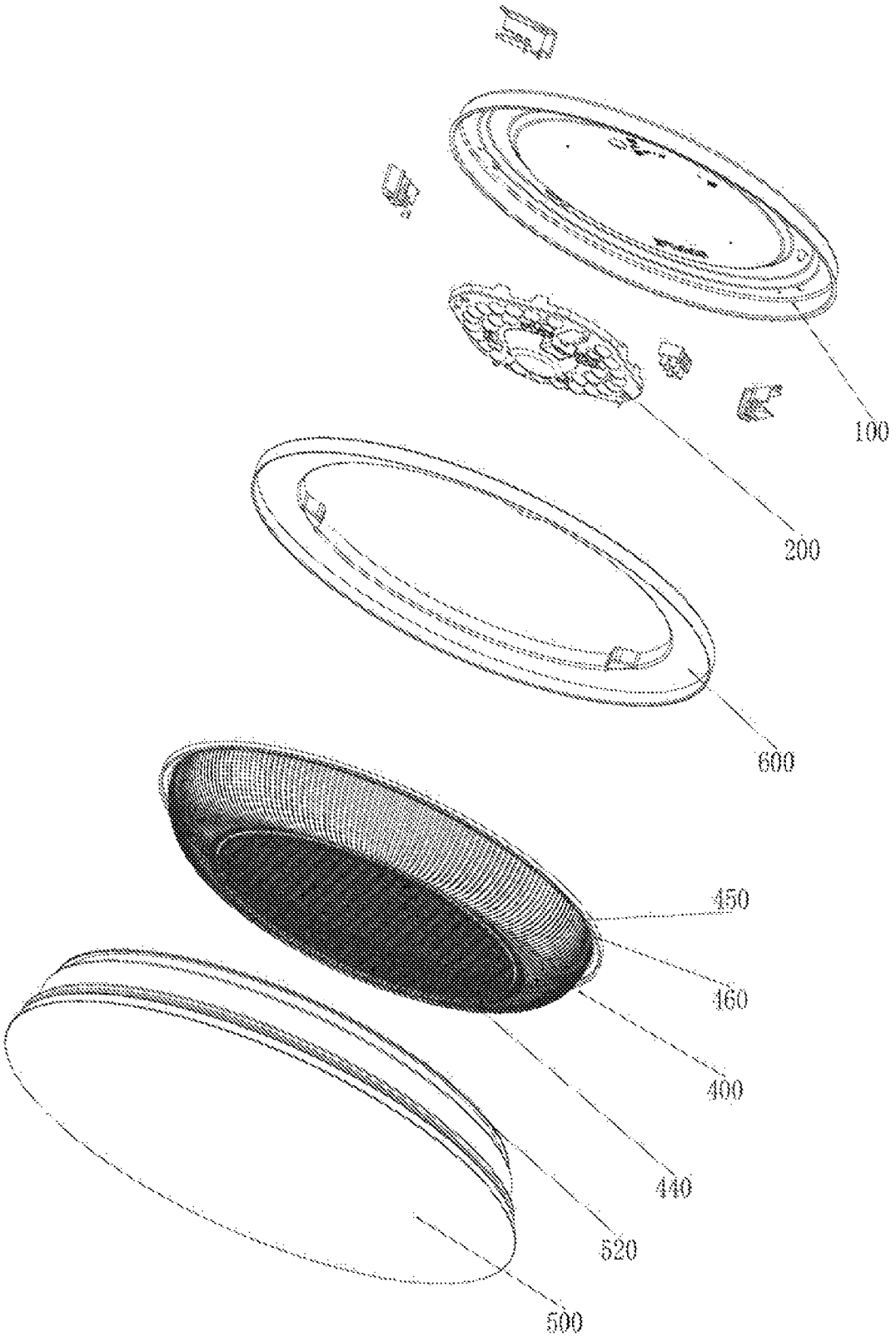
FIG. 10 is an exploded structural diagram of a ceiling lamp in another example of the present disclosure.
Figure 11:
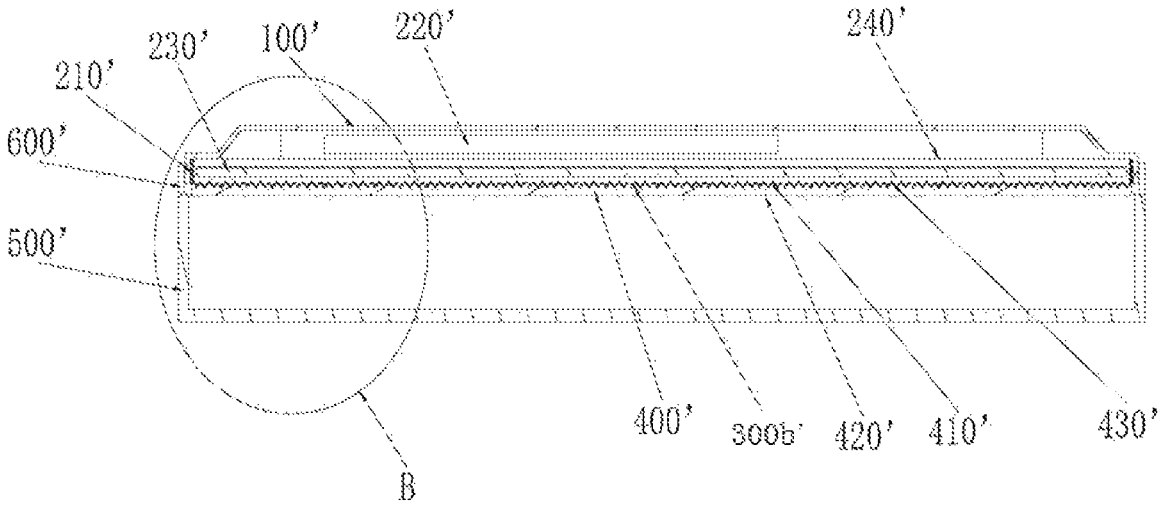
FIG. 11 is a cross-sectional view of a ceiling lamp in another example of the present disclosure.
Figure 12:
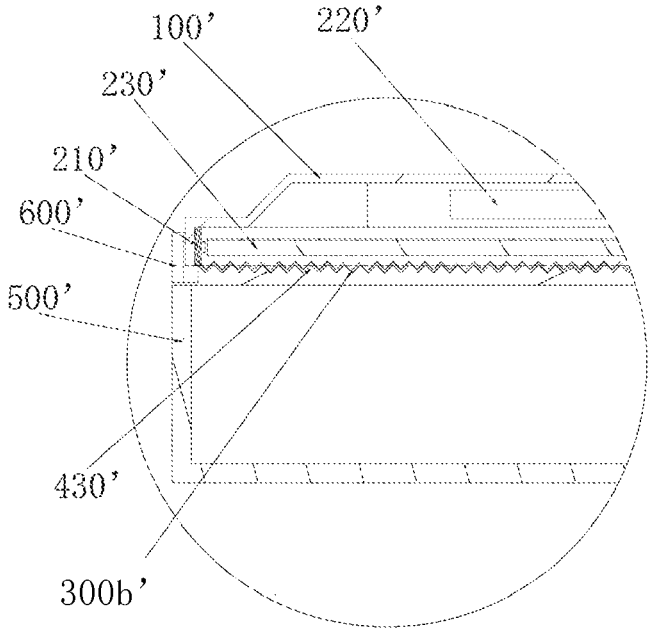
FIG. 12 is an enlarged view of a position B of FIG. 11.
Figure 13:
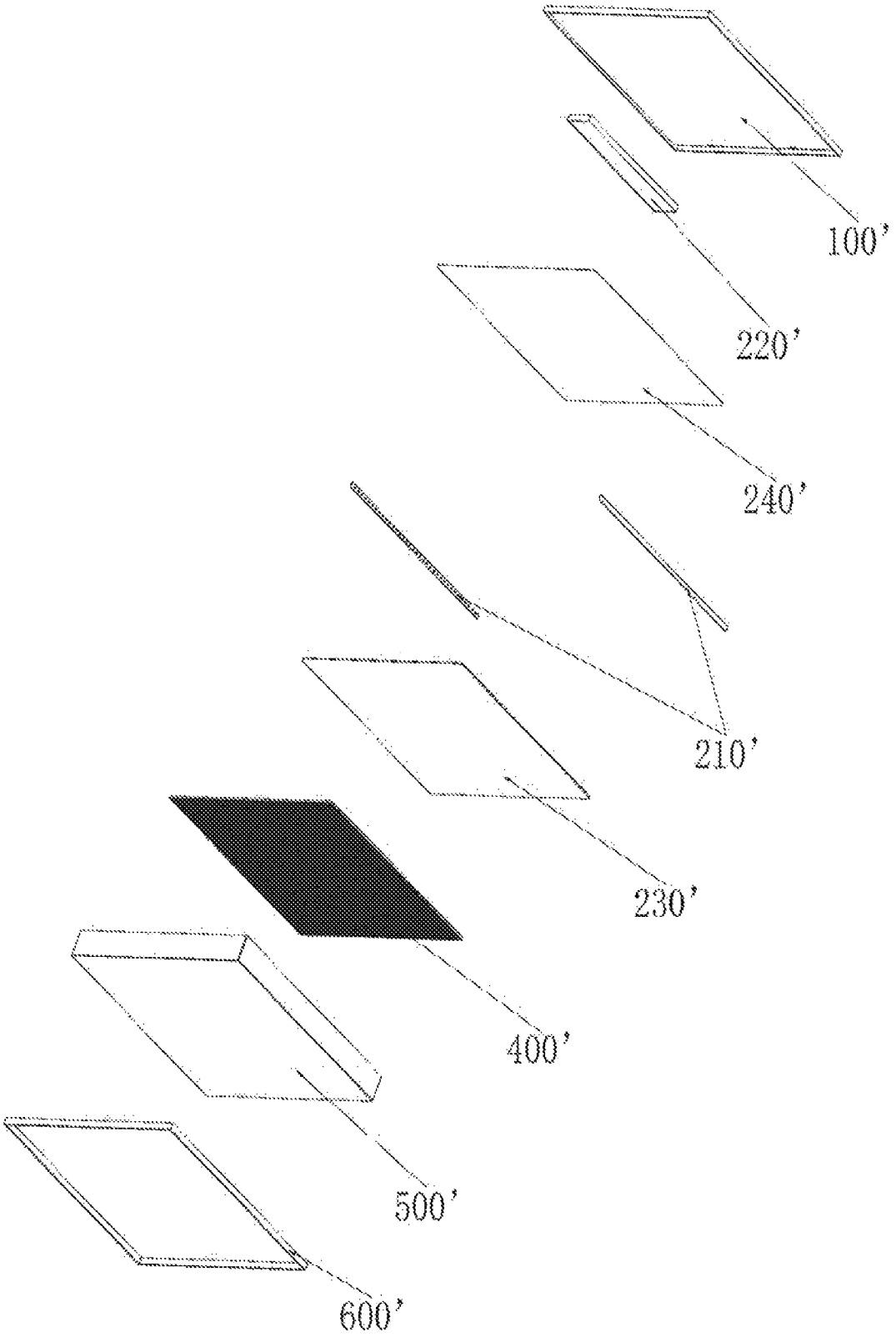
FIG. 13 is an exploded structural diagram of a ceiling lamp in another example of the present disclosure.
Figure 14:
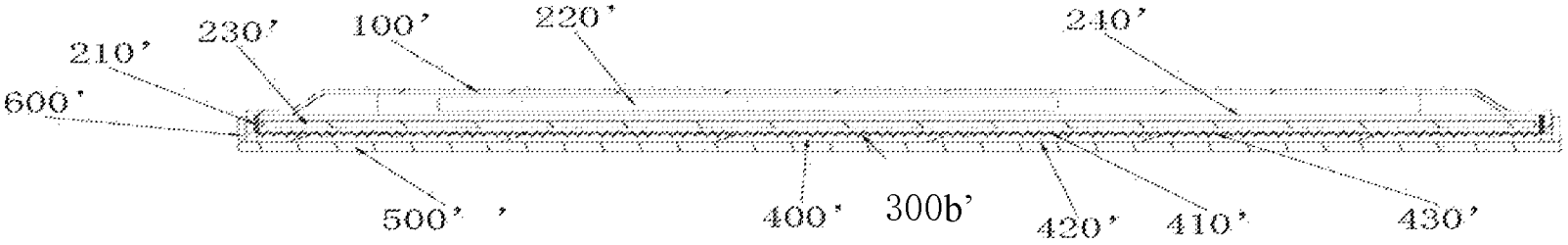
FIG. 14 is a cross-sectional view of a ceiling lamp in another example of the present disclosure.

In the example, a fixing portion 460 of a light transmitting cover is formed by a revers extended by an edge of the light transmitting cover away from a center, a fitting portion 510 of the transparent cover 500 is formed by a revers extended by an edge of the transparent cover 500 close to a center, and a fixing portion 520 of the transparent cover is formed by a revers extended by an edge of the transparent cover 500 away from a center, and the fixing portion 520 of the transparent cover is mounted on the base plate 100 through a fixing structural member 600, and the fitting portion 510 of the transparent cover fixes the fixing portion 460 of the light transmitting cover, referring to FIG. 9.

In another example of the present disclosure, the light transmitting structural member 400, 400' is a light transmitting plate 400' of a flat plate structure, and the diffusing layer **300*b*' is covered on a first side 410' of the light transmitting plate 400', and the light transmitting plate 400'** of the flat plate structure make overall style of the ceiling lamp simple and delicate.

As shown in FIG. 10 to FIG. 14, a ceiling lamp according to the example includes: a base plate 100', a light emitting component 200' and a light transmitting plate 400', the light emitting component 200' is preferably a side-in type light emitting component and arranged on the base plate 100', the light emitting component 200' includes: a light guiding plate 230', a light emitting unit 210' and a driver 220', and further includes a reflecting plate 240', the light guiding plate 230' is arranged parallel to the light transmitting plate 400'; the light emitting unit 210' is arranged in a same plane as the light guiding plate 230' and located at an end portion of the light guiding plate 230'. The diffusing layer **300*b*' is arranged on a first side 410' of the light transmitting plate 400', and configured to evenly irradiate light emitted by the light emitting component 200' into the light transmitting plate 400', and the light transmitting plate 400' is provided with a microprism structure 430', the light transmitting plate is configured to allow the light evenly diffused by diffusing layer 300*b*' to form into a pattern corresponding to the microprism structure 430' with the light evenly diffused by the diffusing layer 300*b*'**.

The diffusing plate **300*a*' is arranged parallel to the light guiding plate 230', the diffusing plate 300*a*' is arranged below the light guiding plate 230', the light transmitting plate 400' is arranged parallel to the diffusing plate 300*a*', and the light transmitting plate 400' is arranged below the diffusing plate 300*a*'**, so as to flatten the entire ceiling lamp, occupying small space.

The diffusing layer **300*b*' is a diffusing material coating layer coated on the first side 410' of the light transmitting plate 400, and the diffusing material coating layer has uniform thickness. The diffusing material layer can be a diffusing material layer formed by coating any diffusing material on the light transmitting plate 400'**, and preferably, the diffusing material coating layer is a polymethyl methacrylate (PMMA) coating layer.

The light guiding plate 230' is arranged parallel to the light transmitting plate 400', so as to flatten the entire ceiling lamp, occupying small space.

The microprism structure 430' includes concave-convex structures arranged in an array and formed by a part of protrusions and/or a part of concaves on a surface of the light transmitting plate 400', and the convex structure of the microprism structure 430' of the light transmitting plate 400' is a dot-shaped protrusion 431' and/or a strip-shaped protrusion.

The structure of the dot-shaped protrusion 431' is a polygonal pyramid structure, and the strip-shaped protrusion has a structure having a polygonal cross section.

In the example, optionally, the microprism structure 430 arranged on the entire surface of the light transmitting plate 400' have a same shape, or the light transmitting plate 400' is divided into at least two regions, the microprism structures 430' are arranged in surfaces of the at least two regions, and the microprism structures 430' arranged in two adjacent ones of the at least two regions have different shapes.

The light emitting component 200' in the example is a side-in type light emitting component, including: a light guiding plate 230', a light emitting unit 210' and a driver 220' of the light emitting unit 210', the light guiding plate 230' is arranged parallel to the light transmitting plate 400'; the light emitting unit 210' is in a same plane as the light guiding plate 230', and located at an end portion of the light guiding plate 230'. The light emitting component occupies small space, and further includes a reflecting plate 240' to reflect light scattered upwardly to a lower part.

In the example, a transparent structural member 500, 500', 500" is further included, and the transparent structural member 500, 500', 500" is a transparent cover 500' of a cover-shell structure having a cavity (referring to FIG. 10), a cavity is provided between the transparent cover 500' and the light transmitting plate 400', so that the ceiling lamp has strong stereoscopic effect; or the transparent structural member is a transparent plate 500" of a flat plate structure (referring to FIG. 14), the transparent plate 500" is arranged parallel and close to the light transmitting plate 400', so that the ceiling lamp is flat and occupies smaller space.

The light transmitting structural member has a first side facing the diffusing structural member and a second side arranged opposite to the first side, and a part or a whole of a surface of the first side and/or the second side of the light transmitting structural member is provided with the microprism structure.

The microprism structure includes concave-convex structures arranged in an array and formed by a part of protrusions and/or a part of concaves on a surface of the light transmitting structural member.

The light transmitting structural member includes a region, and the region is provided with the microprism structure;

Or, the light transmitting structural member is divided into at least two regions in a radial direction or in a circumferential direction, at least one of the at least two regions is provided with the microprism structure, and microprism structures arranged in two adjacent ones of the at least two regions have different shapes.

The ceiling lamp further includes:

A transparent structural member, arranged outside the light transmitting structural member, being of a transparent structure, and configured to transparently diffuse light diffused by the light transmitting structural member, and the transparent structural member is of a smooth structure, or concave folds arranged on a transparent cover.

The ceiling lamp further includes:

A fixing structural member, configured to fixedly mount the diffusing structural member and/or the light transmitting structural member and/or the transparent structural member on the base plate, one end of the fixing structural member being fixedly connected with the diffusing structural member and/or the light transmitting structural member and/or the transparent structural member, and another end of the fixing structural member being fixedly connected with the base plate;

The fixing structural member is a frame-shaped member.

The light emitting component is a side-in type light emitting component or a direct-in type light emitting component.

The diffusing structural member is a diffusing cover of a cover-shell structure having a cavity, and the light transmitting structural member is a light transmitting cover of a cover-shell structure having a cavity.

The light transmitting cover has a bottom portion and a side portion, the side portion being arranged in a peripheral region of the bottom portion and forming a predetermined angle with the bottom portion, the side portion and the bottom portion forming a containing cavity of the lighting emitting component, and the microprism structure being arranged on the bottom portion and/or the side portion.

The microprism structures respectively arranged on the bottom portion and the side portion have different shapes.

The convex structure of the microprism structure on the bottom portion of the light transmitting cover is a dot-shaped protrusion, and/or the convex structure of the microprism structure on the side portion of the light transmitting cover is a strip-shaped protrusion extending from an edge of the bottom portion to an edge of the side portion.

The dot-shaped protrusion has a polygonal pyramid structure, and the strip-shaped protrusion has a structure having a polygonal cross section.

A gap is arranged between the diffusing cover and the light transmitting cover to form a cavity.

The transparent structural member is a transparent cover of a cover-shell structure having a cavity, and a gap is arranged between the transparent cover and the light transmitting cover to form a cavity.

The light emitting component is a direct-in type light emitting component, the light emitting unit is located in a central position of the base plate, and the light emitting component further includes a driver of the light emitting unit.

The light transmitting structural member is a light transmitting plate of a flat plate structure, and the diffusing structural member is a diffusing plate of a flat plate structure.

A convex structure of the microprism structure of the light transmitting plate is a dot-shaped protrusion and/or a strip-shaped protrusion.

The dot-shaped protrusion has a polygonal pyramid structure, and the strip-shaped protrusion has a structure having a polygonal cross section.

The light emitting component is a side-in type light emitting component, including: a light guiding plate, arranged parallel to the diffusing plate; a light emitting unit, arranged in a same plane as the light guiding plate and located in an end portion of the light guiding plate; a driver.

The transparent structural member is a transparent cover of a cover-shell structure having a cavity, and a cavity is arranged between the transparent cover and the light transmitting plate, or the light transmitting structural member is a transparent plate of a flat plate structure, and the transparent plate is arranged parallel and close to the light transmitting plate.

The light transmitting structural member further includes a second side arranged opposite to the first side, and the microprism structure is arranged on a part or a whole of a surface of the first side and/or the second side of the light transmitting structural member.

The first side of the light transmitting structural member is provided with the microprism structure, the second side of the light transmitting structural member is a smooth structure, and the diffusing layer is arranged on the microprism structure of the first side;

Alternatively, the second side of the light transmitting structural member is provided with the microprism structure, the first side of the light transmitting structural member is a smooth structure, and the diffusing layer is arranged on the smooth structure of the first side;

Alternatively, the first side and the second side of the light transmitting structural member are provided with the microprism structures, and the diffusing layer is arranged on the microprism structure of the first side.

The diffusing layer is a diffusing material coating layer coated on the first side of the light transmitting structural member, and the diffusing material coating layer has uniform thickness.

The diffusing material coating layer is a polymethyl methacrylate coating layer.

The microprism structure includes concave-convex structures arranged in an array and formed by a part of protrusions and/or a part of concaves on a surface of the light transmitting structural member, a convex structure of the concave-convex structure is a dot-shaped protrusion and/or a strip-shaped protrusion.

The light transmitting structural member includes a region, and the region is provided with the microprism structure;

Or, the light transmitting structural member is divided into at least two regions in a radial direction or in a circumferential direction, at least one of the at least two regions is provided with the microprism structure, and microprism structures arranged in two adjacent ones of the at least two regions have different shapes.

The ceiling lamp further includes: a transparent structural member, arranged outside the light transmitting structural member, being of a transparent structure, and configured to transparently diffuse light diffused by the light transmitting structural member, the transparent structural member being of a smooth structure, or concave folds being arranged on a transparent cover.

The ceiling lamp further includes: a fixing structural member, which is configured to fixedly mount the light transmitting structural member and/or the transparent structural member on the base plate, one end of the fixing structural member being fixedly connected with the light transmitting structural member and/or the transparent structural member, and the other end of the fixing structural member being fixedly connected with the base plate;

The fixing structural member is a frame member. The light transmitting structural member is a light transmitting cover of a cover-shell structure having a containing cavity, and the diffusing layer is coated on the first side of the light transmitting cover;

Or the light transmitting structural member is a light transmitting plate of a flat plate structure, and the diffusing layer is coated on the first side of the light transmitting plate.

The transparent structural member is a transparent cover of a cover-shell structure having a containing cavity, or the transparent structural member is a transparent plate of a flat plate structure.

Advantageous effects of the technical solutions of the present disclosure include: 1. The ceiling lamp of the present disclosure includes: a base plate, a light emitting component, a diffusing structural member and a light transmitting structural member, and the diffusing structural member plays a role of making light even, so that the light passing the diffusing structural member is diffused evenly, thereby avoiding generating effect of uneven brightness, and the light transmitting structural member is provided with a microprism structure to change a running direction of the light, so that a pattern corresponding to the microprism structure is formed on the light transmitting structural member after the light passes the light transmitting structural member, and the pattern formed in such way has more texture as compared with a pattern directly sprayed onto a surface of the light transmitting structural member.

2. The ceiling lamp of the present disclosure further includes: a transparent structural member, made of a transparent material, and the light become transparent and bright after passing the transparent structural member, thereby improving user experience and visual effect.

The objects, technical details and advantages of the present disclosure have been illustrated in details herein, and it should be understood that, the above are merely specific examples of the present disclosure, and cannot limit the present disclosure. Any modifications, equivalent substitutions, improvements and the like made within the spirit and scope of the disclosure is intended to be included within the scope of the present disclosure.

What is claimed is:

1. A ceiling lamp, comprising:

a base plate;

a light emitting component, comprising a light emitting unit, the light emitting unit being arranged on the base plate;

a diffusing structural member, arranged outside the light emitting unit and configured to evenly diffuse light emitted by the light emitting unit;

a light transmitting structural member, arranged outside the diffusing structural member, the light transmitting structural member being provided with a microprism structure, configured to allow the light evenly diffused by the diffusing structural member to form into a pattern corresponding to the microprism structure on the light transmitting structural member, wherein the light transmitting structural member comprises a bottom portion and a side portion, and each microprism structure arranged on the bottom portion is different from each microprism structure arranged on the side portion; and a transparent structural member, arranged outside the light transmitting structural member and configured to transparently diffuse light diffused by the light transmitting structural member.

2. The ceiling lamp according to claim 1, wherein the light transmitting structural member comprises a first side facing the diffusing structural member and a second side opposite to the first side, a part of or a whole of a surface of the first side and/or the second side of the light transmitting structural member being provided with the microprism structure.

3. The ceiling lamp according to claim 2, wherein the microprism structure comprises concave-convex structures arranged in an array and formed by a part of protrusions and/or a part of concaves on a surface of the light transmitting structural member.

4. The ceiling lamp according to claim 1, wherein the light transmitting structural member comprises a region, the region being provided with the microprism structure;

or the light transmitting structural member is divided into the at least two regions in a radial direction or in a circumferential direction, at least one of the at least two regions being provided with the microprism structure, and microprism structures arranged in two adjacent ones of the at least two regions having different shapes.

5. The ceiling lamp according to claim 1, wherein the transparent structural member is of a transparent structure, the transparent structural member being of a smooth structure, or concave folds being arranged on the light transmitting structural member.

6. The ceiling lamp according to claim 1, wherein the ceiling lamp further comprises:

a fixing structural member, configured to fixedly mount the diffusing structural member and/or the light transmitting structural member and/or the transparent structural member on the base plate, one end of the fixing structural member being fixedly connected with the diffusing structural member and/or the light transmitting structural member and/or the transparent structural member, and another end of the fixing structural member being fixedly connected with the base plate;

the fixing structural member being a frame-shaped member.

7. The ceiling lamp according to claim 1, wherein the diffusing structural member comprises a diffusing cover of a cover-shell structure having a cavity, and the light transmitting structural member comprises a light transmitting cover of a cover-shell structure having a cavity.

8. The ceiling lamp according to claim 7, wherein the light transmitting cover has a bottom portion and a side portion, the side portion being arranged in a peripheral region of the bottom portion and forming a predetermined angle with the bottom portion, the side portion and the bottom portion forming a containing cavity of the lighting emitting component, and the microprism structure being arranged on the bottom portion and/or the side portion.

9. The ceiling lamp according to claim 8, wherein microprism structures respectively arranged on the bottom portion and the side portion have different shapes.

10. The ceiling lamp according to claim 9, wherein a convex structure of the microprism structure on the bottom portion of the light transmitting cover comprises a dot-shaped protrusion, and/or the convex structure of the microprism structure on the side portion of the light transmitting cover comprises a strip-shaped protrusion extending from an edge of the bottom portion to an edge of the side portion.

11. The ceiling lamp according to claim 10, wherein the dot-shaped protrusion comprises a polygonal pyramid structure and the strip-shaped protrusion comprises a structure having a polygonal cross section.

12. The ceiling lamp according to claim 1, wherein the light transmitting structural member comprises a light transmitting plate of a flat plate structure, and the diffusing structural member comprises a diffusing plate of a flat plate structure;

wherein a convex structure of the microprism structure of the light transmitting plate comprises a dot-shaped protrusion and/or a strip-shaped protrusion; and wherein the dot-shaped protrusion comprises a polygonal pyramid structure and the strip- shaped protrusion comprises a structure having a polygonal cross section.

13. A ceiling lamp, comprising:

a base plate;

a light emitting component, comprising a light emitting unit, the light emitting unit being arranged on the base plate; and a light transmitting structural member, a diffusing layer, and a transparent structural member, wherein the light transmitting structural member is arranged outside the light emitting unit, and comprises a first side facing the light emitting unit;

wherein the diffusing layer is arranged on the first side of the light transmitting structural member, and configured to evenly diffuse light emitted by the light emitting component into the light transmitting structural member;

wherein the light transmitting structural member is further provided with a microprism structure, the light transmitting structural member is configured to allow the light evenly diffused by the diffusing structural member to form into a pattern corresponding to the microprism structure, the light transmitting structural member comprises a bottom portion and a side portion, and each microprism structure arranged on the bottom portion is different from each microprism structure arranged on the side portion; and wherein the transparent structural member is arranged outside the light transmitting structural member and configured to transparently diffuse light diffused by the light transmitting structural member.

14. The ceiling lamp according to claim 13, wherein the light transmitting structural member further comprises a second side arranged opposite to the first side, the microprism structure being arranged on a part or a whole of a surface of the first side and/or the second side of the light transmitting structural member.

15. The ceiling lamp according to claim 14, wherein the first side of the light transmitting structural member is provided with the microprism structure, the second side of the light transmitting structural member comprises a smooth structure, and the diffusing layer is arranged on the microprism structure of the first side;

or, the second side of the light transmitting structural member is provided with the microprism structure, the first side of the light transmitting structural member comprises a smooth structure, and the diffusing layer is arranged on the smooth structure of the first side;

or, the first side and the second side of the light transmitting structural member are provided with the microprism structures, and the diffusing layer is arranged on the microprism structure of the first side.

16. The ceiling lamp according to claim 13, wherein the diffusing layer comprises a diffusing material coating layer coated on the first side of the light transmitting structural member, the diffusing material coating layer having a uniform thickness.

17. The ceiling lamp according to claim 16, wherein the diffusing material coating layer comprises a polymethyl methacrylate coating layer.

18. The ceiling lamp according to claim 13, wherein the microprism structure comprises concave-convex structures arranged in an array and formed by a part of protrusions and/or a part of concaves on a surface of the light transmitting structural member, a convex structure of the concave-convex structure comprises a dot-shaped protrusion and/or a strip-shaped protrusion;

wherein the light transmitting structural member comprises at least one region provided with the microprism structure.

19. The ceiling lamp according to claim 13, wherein the transparent structural member is of a transparent structure, the transparent structural member being of a smooth structure, or concave folds being arranged on the light transmitting structural member; and wherein the ceiling lamp further comprises a fixing structural member, configured to fixedly mount the light transmitting structural member and/or the transparent structural member on the base plate, one end of the fixing structural member being fixedly connected with the light transmitting structural member and/or the transparent structural member, and another end of the fixing structural member being fixedly connected with the base plate; wherein the fixing structural member comprises a frame member.

20. The ceiling lamp according to claim 13, wherein the light transmitting structural member comprises one of following structures:

a light transmitting cover of a cover-shell structure having a containing cavity, the diffusing layer being coated on the first side of the light transmitting cover; and a light transmitting plate of a flat plate structure, the diffusing layer being coated on the first side of the light transmitting plate.

* * * * *